US010548456B2

(12) United States Patent
Cao et al.

(10) Patent No.: US 10,548,456 B2
(45) Date of Patent: Feb. 4, 2020

(54) WASHING BASKET ASSEMBLY AND TRAY ASSEMBLY FOR DISH-WASHING MACHINE AND DISH-WASHING MACHINE

(71) Applicant: FOSHAN SHUNDE MIDEA WASHING APPLIANCES MFG. CO., LTD., Foshan (CN)

(72) Inventors: Hongkui Cao, Foshan (CN); Mingfeng Li, Foshan (CN); Feng Gao, Foshan (CN)

( * ) Notice: Subject to any disclaimer, the term of this patent is extended or adjusted under 35 U.S.C. 154(b) by 0 days.

(21) Appl. No.: 15/752,627

(22) PCT Filed: Jan. 4, 2016

(86) PCT No.: PCT/CN2016/070046
§ 371 (c)(1),
(2) Date: Feb. 14, 2018

(87) PCT Pub. No.: WO2017/028478
PCT Pub. Date: Feb. 23, 2017

(65) Prior Publication Data

US 2018/0242816 A1 Aug. 30, 2018

(30) Foreign Application Priority Data

Aug. 19, 2015 (CN) ..... 2015 1 0510769
Aug. 19, 2015 (CN) ..... 2015 2 0628226 U

(51) Int. Cl.
*A47L 15/50* (2006.01)

(52) U.S. Cl.
CPC ..... *A47L 15/502* (2013.01); *A47L 15/50* (2013.01)

(58) Field of Classification Search
CPC ..... A47L 15/502; A47L 15/503; A47L 19/00; A47L 15/505; A47L 15/50; H05K 999/00;
(Continued)

(56) References Cited

U.S. PATENT DOCUMENTS 3,665,943 A * 5/1972 Lampman ..... A47L 15/502 134/200
3,960,290 A * 6/1976 Yake ..... A47L 15/502 220/23.83

(Continued)

FOREIGN PATENT DOCUMENTS

CN 202604765 U 12/2012
CN 202875283 U 4/2013

(Continued)

OTHER PUBLICATIONS

International Search Report dated May 11, 2016 in the corresponding CN appiication (application No. PCT/CN2016/070046).

(Continued)

*Primary Examiner* — Ko H Chan
(74) *Attorney, Agent, or Firm* — Kilpatrick Townsend & Stockton, LLP

(57) ABSTRACT

A washing basket assembly and a tray assembly for a dish-washing machine as well as a dish-washing machine are provided. The washing basket assembly includes a first basket body and a second basket body. The second basket body s disposed to the first basket body and switchable between an opened position and a closed position. When the second basket body is in the closed position, the second basket body and the first basket body are configured to define a receiving cavity having an opening and used for receiving tableware. When the second basket body is in the opened position, a sum of a projection area of the first basket body in a horizontal plane and a projection area of the second basket body in the horizontal plane is larger than the projection area of the first basket body in the horizontal plane.

16 Claims, 4 Drawing Sheets

(58) Field of Classification Search
CPC ..... B65D 25/06; B65D 43/161; B65D 43/22; B65D 43/164; B65D 1/38; D06F 1/12
See application file for complete search history.

(56) References Cited

U.S. PATENT DOCUMENTS 4,221,299 A * 9/1980 Taylor ..... A47L 19/04 211/41.6
4,732,291 A * 3/1988 McConnell ..... A47L 15/505 220/488
5,069,360 A * 12/1991 Dingler ..... A47L 15/502 220/488
5,344,029 A * 9/1994 Oghia ..... A47L 15/505 211/198
6,398,272 B1 * 6/2002 Plummer ..... E05C 19/06 292/246
7,073,682 B2 * 7/2006 Raches ..... A47L 15/502 220/488
7,383,846 B2 * 6/2008 Curran ..... A47L 15/502 134/135
7,445,128 B2 * 11/2008 Kaczmarek ..... A47L 15/502 211/150
7,694,844 B2 * 4/2010 Woo ..... A47L 15/502 211/70.7
8,168,006 B2 * 5/2012 Bengston ..... A47L 15/503 134/135
8,377,227 B2 * 2/2013 Bengston ..... A47L 15/502 134/135
8,522,998 B2 * 9/2013 Crookshanks ..... A47L 15/501 211/41.8
2003/0205259 A1 * 11/2003 McConnell ..... A47L 15/505 134/138
2014/0132136 A1 * 5/2014 Kilic ..... A47L 15/503 312/228.1
2014/0217868 A1 8/2014 Bhajak et al.
2016/0251124 A1 * 9/2016 Arnold ..... B65D 43/162 220/324

FOREIGN PATENT DOCUMENTS

CN 103654677 A 3/2014
CN 105054885 A 11/2015
CN 204950864 U 1/2016
DE 29600642 U1 5/1997
DE 19726553 A1 1/1998
DE 102004057018 A1 6/2006
FR 2643809 A1 9/1990
WO 2014094897 A1 6/2014

OTHER PUBLICATIONS

European Search Report dated Aug. 1, 2018 in the corresponding European application (application No. 16836347.1).
The Office Action dated Aug. 28, 2019 corresponding to CA application No. 2995142.

* cited by examiner

WASHING BASKET ASSEMBLY AND TRAY ASSEMBLY FOR DISH-WASHING MACHINE AND DISH-WASHING MACHINE

CROSS-REFERENCE TO RELATED APPLICATION

This application is a national phase entry under 35 USC § 371 of International Application PCT/CN2016/070046, filed Jan. 4, 2016, which claims priority to and benefits of Chinese Patent Applications Serial No. 201510510769.2 and 201520628226.6, filed with the State Intellectual Property Office of P. R. China on Aug. 19, 2015, the entire contents of which are incorporated herein by reference.

FIELD

The present disclosure relates to washing devices, and more particularly to a washing basket assembly and a tray assembly for a dish-washing machine and a dish-washing machine.

BACKGROUND

A dish-washing machine is provided with a washing basket or a tray therein for placing various kinds of tableware for taking food, such as knives, forks, spoons and the like. The washing basket itself has convenience of tableware transfer, and is generally placed in a bowl basket which is in a lower part of the dish-washing machine. However, when there is much tableware such as dishes, there is no extra space in the bowl basket to place the washing basket. The tray is provided by using the space in a top portion of the dish-washing machine, rather than occupying the space in the bowl basket.

The tray of a traditional dish-washing machine can enable the knives and forks to be put in order and cleaned easily, but the tray itself has a relatively large volume, so it is not convenient for a user to take the tray to a dinner table. When the user needs to take the knives and forks, he/she has to take the knives and forks out of the tray one by one manually, and then takes them to the dinner table for dispensation. When dining is finished, the knives and forks may be taken from the dinner table to the tray and put on the tray. Due to a lack of auxiliary means, the knives and forks has to be received, moved and put by hands, and hence it appears to be troublesome, especially in case of many knives and forks.

SUMMARY

Embodiments of the present disclosure seek to solve at least one of the problems existing in the related art to at least some extent. For that reason, the present disclosure provides a washing basket assembly for a dish-washing machine. The washing basket assembly has advantages of a simple structure as well as a convenient and efficient use.

The present disclosure also provides a tray assembly having the above washing basket assembly for the dish-washing machine.

The present disclosure further provides a dish-washing machine having the above tray assembly.

The washing basket assembly for the dish-washing machine according to embodiments of the present disclosure includes: a first basket body; and a second basket body disposed to the first basket body and switchable between an opened position and a closed position. When the second basket body is located in the closed position, the second basket body and the first basket body are configured to define a receiving cavity having an opening and configured for receiving tableware. When the second basket body is located in the opened position, a sum of a projection area of the first basket body in a horizontal plane and a projection area of the second basket body in the horizontal plane is larger than the projection area of the first basket body in the horizontal plane.

In the washing basket assembly for the dish-washing machine according to embodiments of the present disclosure, by the opening and closing between the first basket body and the second basket body, it is convenient to take and transfer the tableware.

According to some embodiments of the present disclosure, the second basket body is pivotably disposed to the first basket body.

According to some embodiments of the present disclosure, one of the first basket body and the second basket body is provided with a pivot shaft, and the other one of the first basket body and the second basket body is provided with a pivot hole configured to be fitted with the pivot shaft.

According to some embodiments of the present disclosure, one of the first basket body and the second basket body is provided with a protrusion portion, the washing basket assembly further includes a locking piece, one end of the locking piece is pivotably disposed to the other one of the first basket body and the second basket body, and the other end of the locking piece is snap-connected with the protrusion portion.

According to some embodiments of the present disclosure, the other end of the locking piece has a locking groove, and two opposite side walls of the protrusion portion are snap-connected in the locking groove.

The tray assembly according to embodiments of the present disclosure includes: a tray body having a placing space therein; and the above washing basket assembly for the dish-washing machine. The washing basket assembly is put in the placing space and snap-connected with the tray body.

In the tray assembly according to embodiments of the present disclosure, by providing the above washing basket assembly for the dish-washing machine, on one hand, a size of the placing space for the tableware can be changed according to requirements, and on the other hand, it is convenient to take and transfer the tableware.

According to some embodiments of the present disclosure, one of the first basket body and the second basket body is provided with a locking grip, and the locking grip is snap-connected with the tray body.

According to some embodiments of the present disclosure, the placing space includes a first region and a second region distributed in a left and right direction, the first basket body is placed in the second region, and when the second basket body is located in the opened position, the second basket body is placed in the first region.

According to some embodiments of the present disclosure, a plurality of washing basket assemblies are provided and arranged in a front and rear direction.

According to some embodiments of the present disclosure, a bottom wall of the second region is located lower than a bottom wall of the first region.

The dish-washing machine according to embodiments of the present disclosure includes the above tray assembly.

In the dish-washing machine according to embodiments of the present disclosure, by arranging the above-mentioned tray assembly, it is more convenient and efficient for the user to wash and take the tableware.

Figure 1:
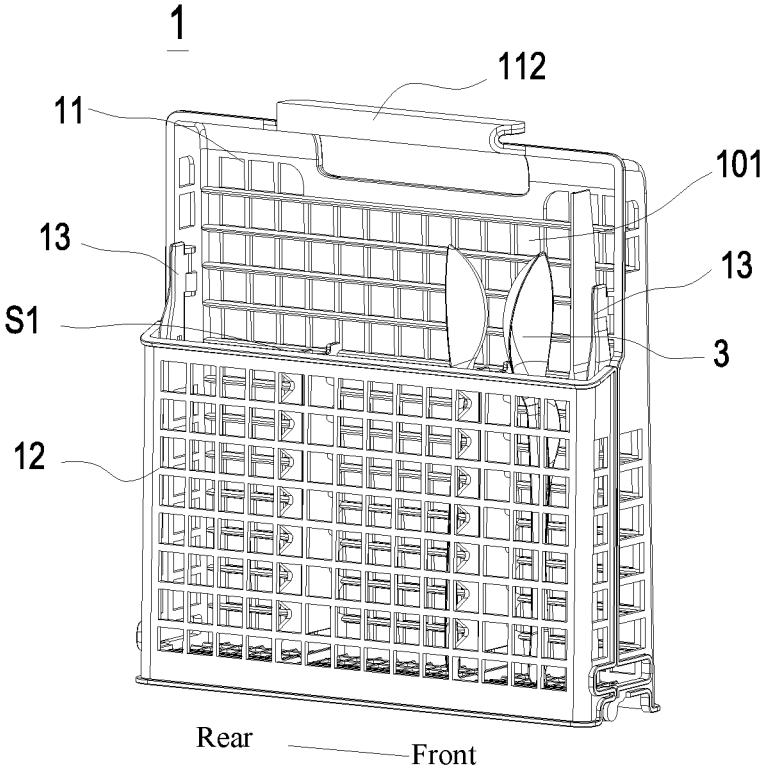
FIG. 1 is a schematic view of a washing basket assembly in a closed position according to embodiments of the present disclosure.
Figure 2:
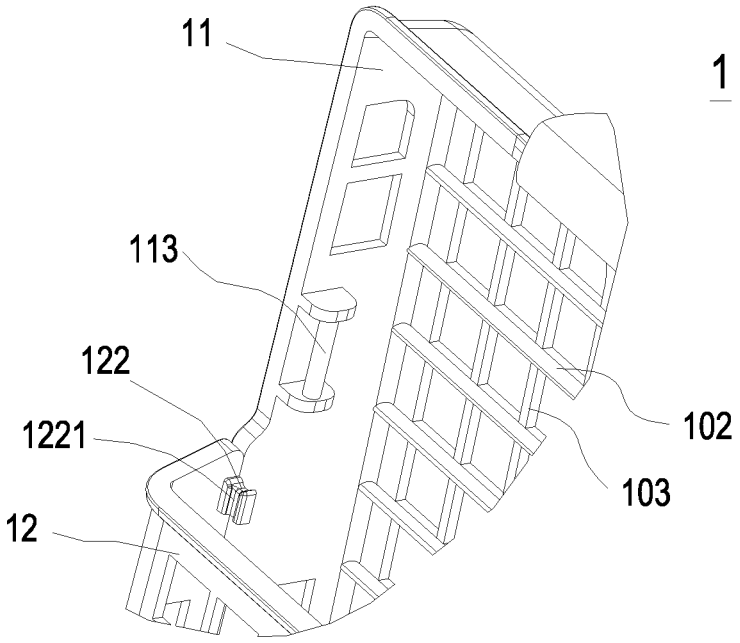
FIG. 2 is a schematic view of a rotating shaft and a protrusion portion of a washing basket assembly according to embodiments of the present disclosure.
Figure 3:
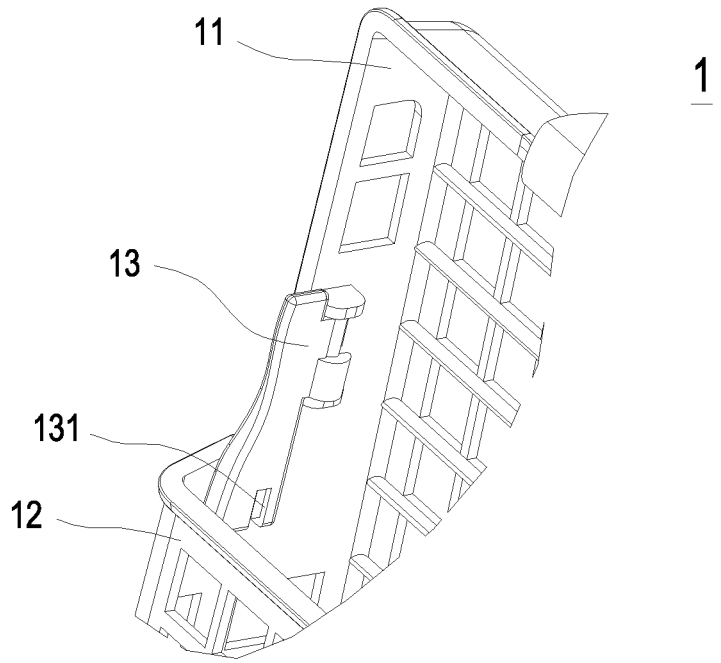
FIG. 3 is a schematic view illustrating a locking piece and a protrusion portion of a washing basket assembly according to embodiments of the present disclosure, in which the locking piece is snap-connected with the protrusion portion.

REFERENCE NUMERALS tray assembly 100,
washing basket assembly 1,
first basket body 11, pivot shaft 111, locking grip 112, rotating shaft 113, second basket body 12, pivot hole 121, protrusion portion 122, side wall 1221, locking piece 13, locking groove 131,
bottom portion 14 of washing basket assembly, bottom portion 141 of first basket body, bottom portion 142 of second basket body,
cell 101, receiving cavity S1, first rib 102, second rib 103,
tray body 2,
first region Z21, bottom wall 211 of first region, second region Z22, bottom wall 221 of second region,
coaming plate 23, supporting frame 24, track roller 25, baffle plate 26, tooth rib 27,
tableware 3.

DETAILED DESCRIPTION

Embodiments of the present disclosure will be described in detail below, examples of the embodiments are shown in the drawings. The embodiments described herein with reference to drawings are explanatory, and used to generally understand the present disclosure. The embodiments shall not be construed to limit the present disclosure.

In the specification, it is to be understood that terms such as "width," "upper," "lower," "front," "rear," "left," "right," "vertical," "horizontal," "bottom," "inner" and "outer" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements.

A washing basket assembly 1 for a dish-washing machine according to embodiments of the present disclosure will be described in detail with reference to FIGS. 1-7 in below.

As shown in FIGS. 1-7, the washing basket assembly 1 for the dish-washing machine according to embodiments of the present disclosure includes a first basket body 11 and a second basket body 12.

Figure 4:
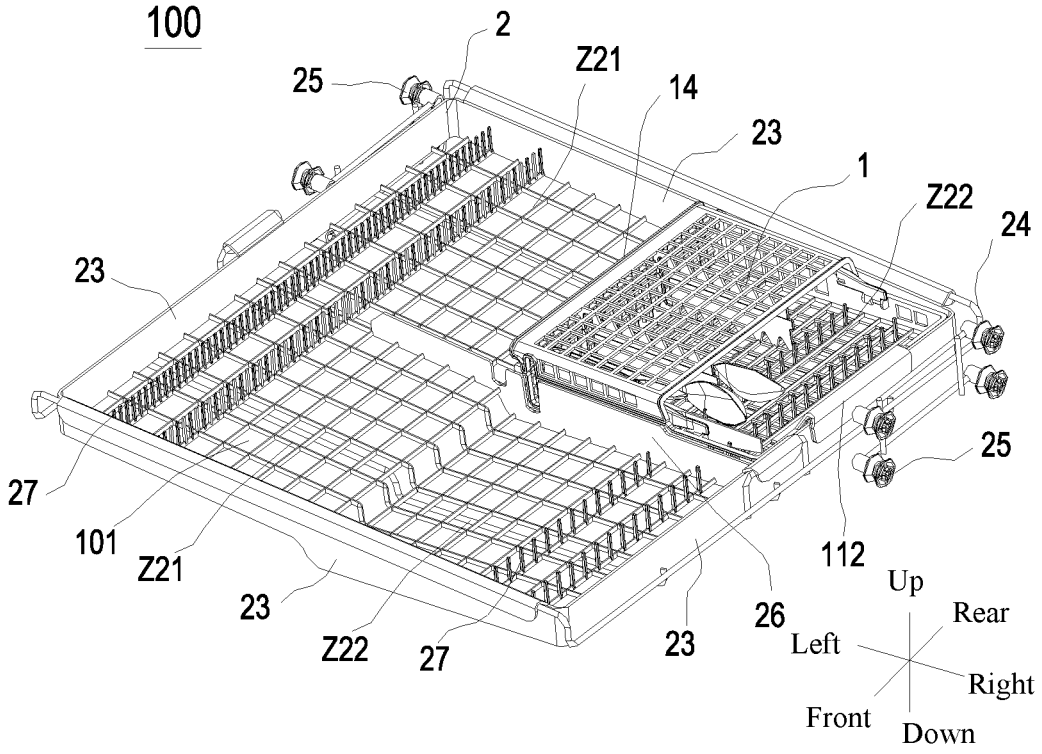
FIG. 4 is a perspective view of a tray assembly according to embodiments of the present disclosure, in which a washing basket assembly is in a closed position.
Figure 5:
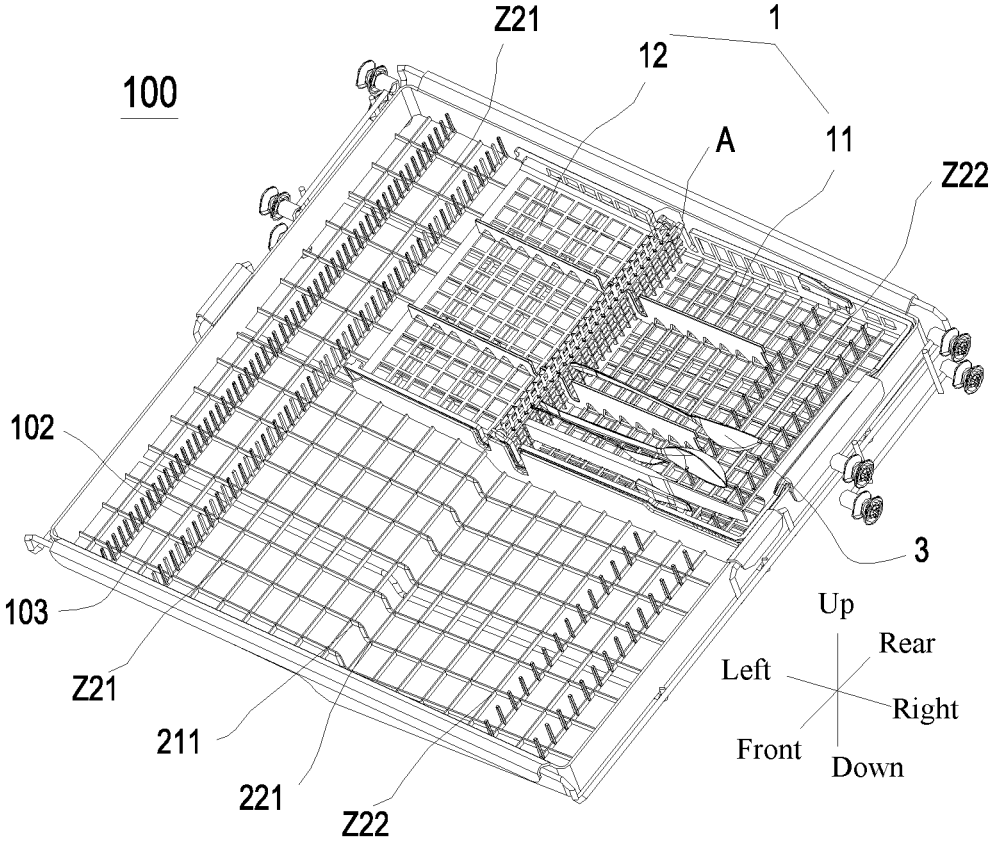
FIG. 5 is a perspective view of a tray assembly according to embodiments of the present disclosure, in which a washing basket assembly is in an opened position.
Figure 7:
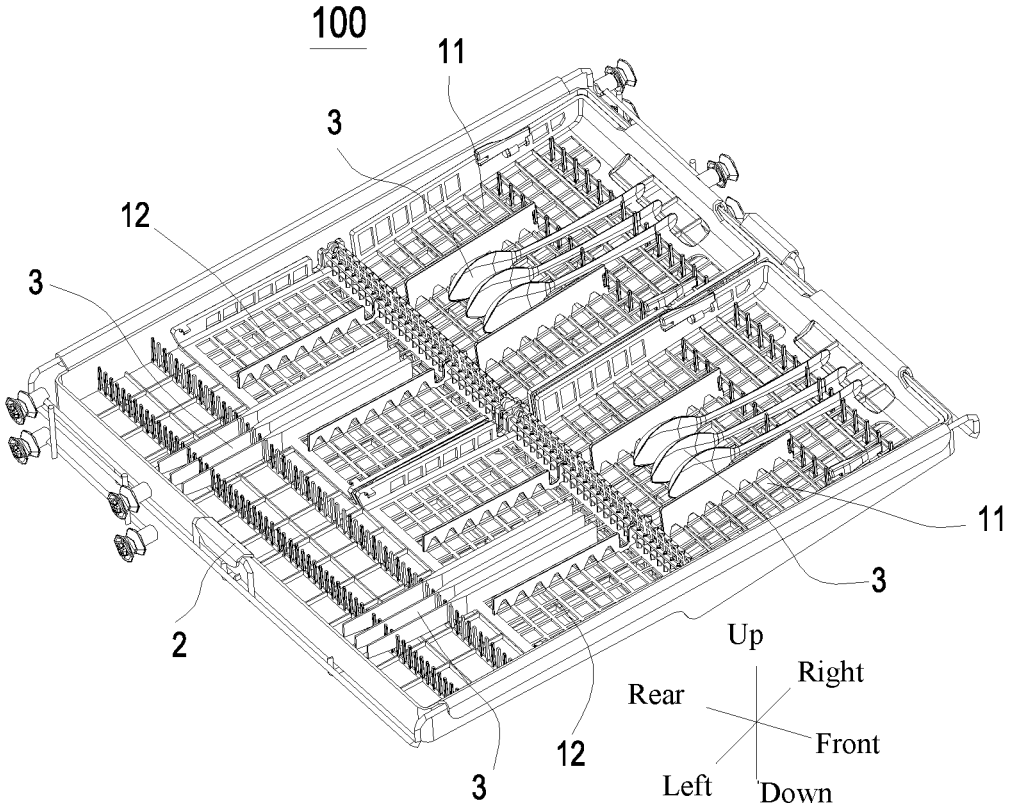
FIG. 7 is a schematic view of a tray assembly according to embodiments of the present disclosure, in which two washing basket assemblies are put on a tray body.

In one embodiment, the second basket body 12 is disposed to the first basket body 11 and switchable between an opened position and a closed position. That is, the second basket body 12 is disposed to the first basket body 11, and the second basket body 12 can switch in terms of position by rotating or moving. For example, the second basket body 12 can be switched from the opened position to the closed position by rotating (as shown in FIGS. 1 and 4, the second basket body 12 is located in the closed position) or can be switched from the closed position to the opened position by rotating (as shown in FIGS. 5 and 7, the second basket body 12 is located in the opened position). When the second basket body 12 is located in the closed position, the second basket body 12 and the first basket body 11 can be configured to define a receiving cavity S1 used for receiving tableware 3 and having an opening, as shown in FIGS. 1 and 4, and the receiving cavity S1 can be used for receiving the tableware 3 such as knives, forks, spoons and the like. When the second basket body 12 is located in the opened position, a sum of a projection area of the first basket body 11 in a horizontal plane and a projection area of the second basket body 12 in the horizontal plane is larger than the projection area of the first basket body 11 in the horizontal plane, that is, when the second basket body 12 is located in the opened position, a space of the washing basket assembly 1 for placing the tableware 3 can be increased, such that in case of lots of tableware 3, the tableware 3 can be placed by means of this manner. In addition, the washing basket assembly 1 located in the closed position can also serve as a transfer tool for the tableware 3, so as to avoid receiving and moving the tableware 3 by hands, which thus saves much trouble and is convenient and efficient, especially in case of much tableware.

It could be understood that, in the washing basket assembly 1 for the dish-washing machine according to embodiments of the present disclosure, the first basket body 11 and the second basket body 12 each can be formed by a plurality of first ribs 102 parallel to and spaced apart from each other, and a plurality of second ribs 103 parallel to and spaced apart from each other, in which, the first rib 102 and the second rib 103 are perpendicular to each other, two adjacent first ribs 102 and two adjacent second ribs 103 construct a square cell 101 (as shown in FIGS. 1-7), such that when the washing basket assembly 1 is used to wash the tableware 3, water can enter the washing basket assembly 1 through the cell 101, so as to be fully contacted with the tableware 3, thereby reaching the purpose of cleaning the tableware 3. At the same time, the water after washing can also flow out of the washing basket assembly 1 through the cell 101, thereby making it convenient to drain and dry the tableware 3.

In the washing basket assembly 1 for the dish-washing machine according to embodiments of the present disclosure, by providing the second basket body 12 switchable between the opened position and the closed position, when the second basket body 12 is located in the closed position, the receiving cavity S1 can be used for receiving the tableware 3 such as knives, forks, spoons and the like, thus making it convenient to receive or transfer the tableware 3 quickly; when the second basket body 12 is located in the opened position, the space for placing the tableware 3 can be increased, thereby making it possible to contain more tableware 3. Thus, practicability of the washing basket assembly 1 is increased greatly, thereby satisfying use requirements of the user, and improving competitiveness of the product.

According to an embodiment of the present disclosure, as shown in FIGS. 1 and 4-6, the second basket body 12 is pivotably disposed to the first basket body 11, that is, the second basket body 12 can perform the switch between the closed position and the opened position on the first basket body 11 by means of pivoting. Thus, the structure of the washing basket assembly 1 is more compact and reasonable.

In one embodiment, one of the first basket body 11 and the second basket body 12 can be provided with a pivot shaft 111, and the other one of the first basket body 11 and the second basket body 12 can be provided with a pivot hole 121 configured to be fitted with the pivot shaft 111, that is to say, the pivot shaft 111 is mounted in the pivot hole 121, such that the second basket body 12 can rotate about the pivot shaft 111 on the first basket body 11, thereby enabling the second basket body 12 to be switched between the closed position and the opened position.

Figure 6:
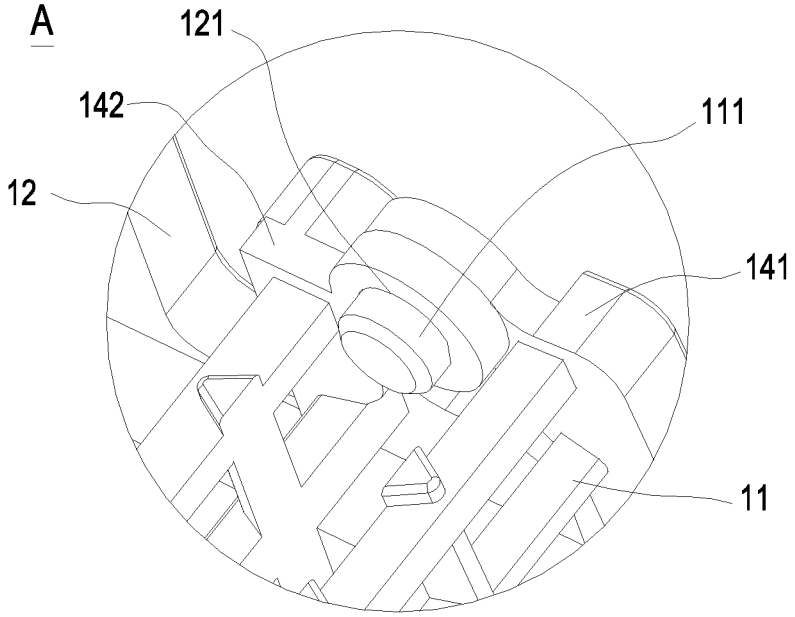
FIG. 6 is a partially enlarged view of portion A in FIG. 5.

In the examples shown in FIGS. 5 and 6, the first basket body 11 is provided with the pivot shaft 111, the pivot shaft 111 is connected to a bottom portion 141 of the first basket body; accordingly, the second basket body 12 is provided with the pivot hole 121 configured to be fitted with the pivot shaft 111, the pivot hole 121 is connected to a bottom portion 142 of the second basket body, such that the second basket body 12 can rotate about the pivot shaft 111 on the first basket body 11, thereby enabling the second basket body 12 to be switched between the closed position and the opened position. According to an embodiment of the present disclosure, two pivot shafts 111 are provided and symmetrically disposed to a front side wall and a rear side wall of the first basket body 11, accordingly, two pivot holes 121 are provided and having a one to one correspondence with the pivot shafts 111, thereby improving the connection reliability between the first basket body 11 and the second basket body 12.

As shown in FIGS. 5 and 7, the second basket body 12 rotates about the pivot shaft 111 on the first basket body 11 in a direction of running away from the first basket body 11, so as to place the second basket body 12 in the opened position, thereby increasing the space of the washing basket assembly 1 for placing the tableware 3. As shown in FIGS. 1 and 4, the second basket body 12 rotates about the pivot shaft 111 on the first basket body 11 in a direction of approaching the first basket body 11, so as to place the second basket body 12 in the closed position, and receive the tableware 3 in the receiving cavity S1, thus making it convenient to take the washing basket assembly 1 out of the dish-washing machine, thereby making it convenient for the user to take the tableware 3 or transfer the washing basket assembly 1 carried with the tableware 3.

According to an embodiment of the present disclosure, one of the first basket body 11 and the second basket body 12 is provided with a protrusion portion 122, the washing basket assembly 1 further includes a locking piece 13, one end of the locking piece 13 is pivotably disposed to the other one of the first basket body 11 and the second basket body 12, and the other end of the locking piece 13 is snap-connected with the protrusion portion 122. In the examples shown in FIGS. 1 and 2, the first basket body 11 is provided with a rotating shaft 113, the rotating shaft 113 can be fixed to an inner side of the first basket body 11, the one end of the locking piece 13 can pivot on the first basket body 11 through its fit with the rotating shaft 113; the second basket body 12 is provided with the protrusion portion 122, and an end of the protrusion portion 122 is fixed to an inner side of the second basket body 12.

According to an embodiment of the present disclosure, the first basket body 11 is provided with two rotating shafts 113 symmetrically arranged. Accordingly, two protrusion portions 122 and two locking pieces 13 are provided and symmetrically arranged in corresponding positions, thus further improving the connection reliability between the first basket body 11 and the second basket body 12.

Furthermore, the other end of the locking piece 13 has a locking groove 131, and two opposite side walls 1221 of the protrusion portion 122 are snap-connected in the locking groove 131. In the examples shown in FIGS. 1-3, the locking piece 13 is snap-connected with the protrusion portion 122 through the locking groove 131, the two opposite side walls 1221 of the protrusion portion 122 are snap-connected in the locking groove 131, and a shape of the locking groove 131 is matched with that of the protrusion portion 122. According to an embodiment of the present disclosure, the protrusion portion 122 is low in middle and high at two sides, thus enabling the locking piece 13 to be firmly snap-connected with the protrusion portion 122 and not easy to be broken away from the protrusion portion 122.

That is, when the second basket body 12 needs to be switched to the closed position, the second basket body 12 is rotated about the pivot shaft 111 in the direction of approaching the first basket body 11, and when the second basket body 12 is rotated to the closed position, the locking piece 13 is then rotated to be snap-connected with the protrusion portion 122, such that an upper part of the first basket body 11 and an upper part of the second basket body 12 are firmly connected, thereby constructing the receiving cavity S1 having the opening, which is used for receiving the tableware 3 such as knives, forks, spoons and the like. In this case, the washing basket assembly 1 can be used as a tool for transferring the tableware 3. When the second basket body 12 needs to be switched to the opened position, the locking piece 13 is rotated first, so that the locking piece 13 is disengaged from the protrusion portion 122, and then the second basket body 12 is rotated about the pivot shaft 111 in the direction of running away from the first basket body 11, till the opened position, in which case, the tableware 3 such as knives, forks, spoons and the like can be put on the second basket body 12, and hence the space for placing the tableware 3 is increased.

According to another embodiment (not shown in the drawings) of the present disclosure, the second basket body 12 is slidably disposed to the first basket body 11, that is, the second basket body 12 can move on the first basket body 11 by means of sliding. For example, one of the first basket body 11 and the second basket body 12 can be provided with a track, and correspondingly, the other one of the first basket body 11 and the second basket body 12 can be provided with a sliding block configured to be fitted with the track, such that the sliding block can slide on the track, and hence the second basket body 12 can slide on the first basket body 11. When the first basket body 11 and the second basket body 12 move away from each other, the second basket body 12 is to be located in the opened position; when the first basket body 11 and the second basket body 12 approach each other, the second basket body 12 is to be located in the closed position.

A tray assembly 100 according to embodiments of the present disclosure includes a tray body 2 and the above washing basket assembly 1 for the dish-washing machine. The tray body 2 has a placing space, and the washing basket assembly 1 is put in the placing space and is snap-connected with the tray body 2. That is, when washing the tableware 3, the tableware 3 such as the knives, the forks, the spoons and the like to be washed are put in the washing basket assembly 1, then the washing basket assembly 1 is put in the tray body 2, such that when washing, taking and transferring the tableware 3, it just needs to transfer the washing basket assembly 1, rather than putting the tableware 3 in the tray one by one or picking up the tableware 3 from the tray one by one, thereby enabling taking and transfer of the tableware 3 to be convenient and efficient.

According to an embodiment of the present disclosure, as shown in FIGS. 4-7, a bottom portion of the tray body 2 has the square cell 101. When washing the tableware 3, water can enter the tray body 2 through the cell 101, so as to be fully contacted with the tableware 3, thereby reaching the purpose of cleaning the tableware 3. When the washing is finished, the tray body 2 having the cell 101 can also facilitate draining or drying of the tableware 3. The tray body 2 can also be provided with a coaming plate 23, the coaming plate 23 can be arranged at en edge of the tray body 2, so as to define the placing space together with the tray body 2, thus effectively preventing the tableware 3 from slipping off from the tray body 2.

It should be noted that, the washing basket assembly 1 can be put in the placing space in the tray body 2, and also, the tableware 3 to be washed can be put in the placing space alone.

It could be understood that, the tray assembly 100 can further include a supporting frame 24 and a track roller 25, the supporting frame 24 can be used to support the tray body 2, and the track roller 25 can be provided to the supporting frame 24, such that it is convenient to push the tray body 2.

In the tray assembly 100 according to embodiments of the present disclosure, by providing the above washing basket assembly 1, i.e. by the cooperative use of the tray body 2 and the washing basket assembly 1, the taking and transfer of the tableware 3 are convenient and efficient.

According to an embodiment of the present disclosure, one of the first basket body 11 and the second basket body 12 is provided with a locking grip 112, and the locking grip 112 is snap-connected with the tray body 2. In examples shown in FIGS. 1 and 4, an upper end of the first basket body 11 of the washing basket assembly 1 is provided with the locking grip 112, and the locking grip 112 is snap-connected to the coaming plate 23 at a right (such as a right direction shown in FIG. 4) side of the tray body 2, such that the washing basket assembly 1 is firmly arranged in the placing space of the tray body 2.

According to an embodiment of the present disclosure, the placing space includes a first region Z21 and a second region Z22 distributed in a left and right direction (such as a left and right direction shown in FIGS. 4-7), the first basket body 11 is placed in the second region Z22, and when the second basket body 12 is located in the opened position, the second basket body 12 is placed in the first region Z21. Thus, a compact degree of the structure of the tray assembly 100 is improved, and also, a utility rate of the placing space is enhanced effectively.

According to an embodiment of the present disclosure, a bottom wall 221 of the second region is located lower than a bottom wall 211 of the first region, such that when the second basket body 12 is located in the opened position, the second basket body 12 can be horizontally placed in the first region Z21, and hence the tableware 3 in the second basket body 12 can be placed steadily. In the example shown in FIG. 4, a vertical distance between the bottom wall 211 of the first region and the bottom wall 221 of the second region is substantially equivalent to a width of a bottom portion 14 of the washing basket assembly. When the washing basket assembly 1 is placed in the placing space in the tray, the bottom portion 14 of the washing basket assembly abuts against a vertical (an up and down direction shown in FIGS. 4-7) plane formed by the bottom wall 211 of the first region and the bottom wall 221 of the second region.

According to an embodiment of the present disclosure, as shown in FIGS. 4-7, two rows of tooth ribs 27 are arranged in a left side of the first region Z21 and another two rows of tooth ribs 27 are arranged in a right side of the second region Z22. The two rows of tooth ribs 27 are used to separate the tableware 3 into groups or individuals, thereby avoiding the fact that the tableware 3 is gathered and piled under impact of the water flow when being washed and hence may not be cleaned, while keeping the tableware 3 in order. The two rows of tooth ribs 27 in the left side of the first region Z21 are denser than the two rows of tooth ribs 27 in the right side of the second region Z22, such that when the second basket body 12 is located in the opened position, the tableware 3 can be neatly placed between the tooth ribs 27.

That is, when the tray assembly 100 according to embodiments of the present disclosure is used for washing the tableware 3, the tableware 3 can be placed in the washing basket assembly 1, and then the washing basket assembly 1 can be placed in the tray for washing. When there is little tableware 3 to be washed or the user chooses to put the tableware 3 dispersedly, the second basket body 12 can be located in the closed position, in which case the whole washing basket assembly 1 is placed in the second region Z22, and when the washing is finished, the washing basket assembly 1 can be directly taken out and the clean tableware 3 is available. When there is much tableware 3 to be washed or the user chooses to put the tableware 3 in order, the second basket body 12 can be located in the opened position, in which case the first basket body 11 is located in the second region Z22 and the second basket body 12 is located in the first region Z21, thus increasing the placing space of the tableware 3. In this case, a part of the tableware 3 can be neatly placed between the two rows of tooth ribs 27 in the first region Z21.

According to an embodiment of the present disclosure, a plurality of washing basket assemblies 1 are provided and arranged in the tray body 2 in a front and rear direction (a front and rear direction shown in FIGS. 4-7), such that the placing space for the tableware 3 can be increased according to requirements. In the example shown in FIG. 7, two washing basket assemblies 1 are provided in the placing space of the tray body 2 in the front and rear direction (the front and rear direction shown in FIG. 7). Front and rear regions where the two washing basket assemblies 1 are correspondingly located are partitioned by a baffle plate 26, thus enabling the arrangement in the whole tray assembly 100 to be neat.

A dish-washing machine according to embodiments of the present disclosure includes the above tray assembly 100.

In the dish-washing machine according to embodiments of the present disclosure, by providing the above tray assembly 100, washing, taking and transfer of the tableware 3 are convenient and efficient.

Reference throughout this specification to "an embodiment," "some embodiments," "one embodiment", "another example," "an example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," or "in some examples," in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A tray assembly, comprising:

a tray body configured to be substantially horizontal in use, having a placing space therein; and a washing basket assembly for a dish-washing machine, comprising: a first basket body; and a second basket body disposed to the first basket body and switchable between an opened position and a closed position, wherein when the second basket body is in the closed position, the second basket body and the first basket body are configured to define a receiving cavity having an opening and configured for receiving tableware; and wherein when the second basket body is in the opened position, a sum of a projection area of the first basket body in a horizontal plane and a projection area of the second basket body in the horizontal plane is larger than the projection area of the first basket body in the horizontal plane, wherein the washing basket assembly being arranged in the placing space and snap-connected with the tray body, and wherein when the second basket body is in the opened position, the second basket body defines a receiving space for placing tableware in the receiving space;

wherein the placing space comprises a first region and a second region distributed in a left and right direction, the first basket body is placed in the second region, and when the second basket body is located in the opened position, the second basket body is placed in the first region;

wherein a bottom wall of the second region is located lower than a bottom wall of the first region;

wherein a vertical distance between the bottom wall of the first region and the bottom wall of the second region is substantially equivalent to a width of a bottom portion of the washing basket assembly.

2. The tray assembly according to claim 1, wherein one of the first basket body and the second basket body is provided with a locking grip, and the locking grip is snap-connected with the tray body.

3. The tray assembly according to claim 1, wherein a plurality of washing basket assemblies are provided and arranged in a front and rear direction.

4. A dish-washing machine, comprising: a tray assembly, comprising:

a tray body configured to be substantially horizontal in use, having a placing space therein; and a washing basket assembly for a dish-washing machine, comprising: a first basket body; and a second basket body disposed to the first basket body and switchable between an opened position and a closed position, wherein when the second basket body is in the closed position, the second basket body and the first basket body are configured to define a receiving cavity having an opening and configured for receiving tableware; and wherein when the second basket body is in the opened position, a sum of a projection area of the first basket body in a horizontal plane and a projection area of the second basket body in the horizontal plane is larger than the projection area of the first basket body in the horizontal plane, wherein the washing basket assembly being arranged in the placing space and snap-connected with the tray body, and wherein when the second basket body is in the opened position, the second basket body defines a receiving space for placing tableware in the receiving space;

wherein the placing space comprises a first region and a second region distributed in a left and right direction, the first basket body is placed in the second region, and when the second basket body is located in the opened position, the second basket body is placed in the first region;

wherein a bottom wall of the second region is located lower than a bottom wall of the first region;

wherein a vertical distance between the bottom wall of the first region and the bottom wall of the second region is substantially equivalent to a width of a bottom portion of the washing basket assembly.

5. The tray assembly according to claim 1, wherein the second basket body is slidably disposed to the first basket body.

6. The tray assembly according to claim 1, wherein the tray body further comprises at least one square cell.

7. The tray assembly according to claim 1, wherein the tray body further comprises at least one coaming plate.

8. The tray assembly according to claim 1, wherein the tray assembly further comprises a supporting frame and a track roller.

9. The tray assembly according to claim 1, wherein at least one row of tooth rib is disposed in the placing space.

10. The tray assembly according to claim 9, wherein two rows of first tooth ribs are disposed in left side of the first region, and two rows of second tooth ribs are disposed in right side of the second region.

11. The tray assembly according to claim 10, wherein the first tooth ribs are denser than the second tooth ribs.

12. The tray assembly according to claim 1, wherein the second basket body is pivotably disposed to the first basket body.

13. The tray assembly according to claim 12, wherein one of the first basket body and the second basket body is provided with a pivot shaft, and the other one of the first basket body and the second basket body is provided with a pivot hole configured to be fitted with the pivot shaft.

14. The tray assembly according to claim 1, wherein one of the first basket body and the second basket body is provided with a protrusion portion, and the washing basket assembly comprises a locking piece, one end of the locking piece being pivotably disposed to the other one of the first basket body and the second basket body, and the other end of the locking piece being snap-connected with the protrusion portion.

15. The tray assembly according to claim 14, wherein the other end of the locking piece has a locking groove, and two opposite side walls of the protrusion portion are snap-connected in the locking groove.

16. The tray assembly according to claim 1, wherein the second basket body is slidably disposed to the first basket body.

* * * * *